United States Patent [19]

Pabst

[11] Patent Number: 4,840,088

[45] Date of Patent: Jun. 20, 1989

[54] MECHANICAL TRANSMISSION, PARTICULARLY FOR CABLEWAY WINCHES

[75] Inventor: Otto Pabst, Meransen, Italy

[73] Assignee: Leitner, S.p.A., Bolzano, Italy

[21] Appl. No.: 229,723

[22] Filed: Aug. 4, 1988

Related U.S. Application Data

[63] Continuation-in-part of Ser. No. 24,008, Mar. 10, 1987, abandoned.

[30] Foreign Application Priority Data

Mar. 11, 1986 [IT] Italy ..... 21190/86[U]

[51] Int. Cl.[4] ..... F16H 37/06

[52] U.S. Cl. ..... 74/661; 192/48.91; 464/159

[58] Field of Search ..... 74/661, 665 E, 370; 192/48.8, 48.91; 464/157, 158, 159

[56] References Cited

U.S. PATENT DOCUMENTS

| | | | |
|---|---|---|---|
| 2,573,011 | 10/1951 | Gruber | 74/661 |
| 2,659,585 | 11/1953 | McCallum | 464/159 X |
| 2,792,723 | 5/1957 | Zelewsky | 74/661 |
| 2,805,042 | 9/1957 | O'Leary | 74/661 |
| 3,200,919 | 8/1965 | Lanigan et al. | 192/48.91 |
| 3,779,100 | 12/1973 | Schmidt | 74/665 GE X |
| 4,411,170 | 10/1983 | Vogelgesang | 74/661 |
| 4,457,735 | 7/1984 | Carman et al. | 464/158 X |
| 4,464,141 | 8/1984 | Brown | 464/159 X |
| 4,679,326 | 7/1987 | Takizawa et al. | 192/48.91 |

FOREIGN PATENT DOCUMENTS

| | | | |
|---|---|---|---|
| 1172488 | 7/1958 | Fed. Rep. of Germany | 464/159 |

*Primary Examiner*—Dirk Wright

*Attorney, Agent, or Firm*—Oblon, Fisher, Spivak, McClelland & Maier

[57] ABSTRACT

A mechanical transmission comprises first and second speed reduction gears arranged above each other and a shaft operated by the gears, the shaft supporting at a free end a pulley coaxially rotatable therewith. A first articulated coupling is axially slidable on the shaft between the gears and is provided with a lower and upper toothing. The upper toothing engages with a first flanged sleeve rotatably connected to the first reduction gear and the lower toothing is connected to a second flanged sleeve rotatably connected to the second reduction gear, and axially slidable within a seat thereof.

1 Claim, 2 Drawing Sheets shaft 13 to which it is connected (by means of toothing 30). However, in this case, in order to withdraw the first reduction gear 12, it is further necessary to partly withdraw the shaft 13 from above by momentarily removing the first flange 14 and the first articulated coupling 19.

In this manner, with the transmission according to the present invention, not only can the pulleys 15 be operated by one or by both reduction gears 12, 11 at choice, but in addition the time involved in replacing the reduction gears 12, 11 or maintaining them is considerably reduced.

FIG. 2 shows an operative arrangement in which the second reduction gear 11 has been disconnected (e.g., for maintenance operations) by unscrewing the flanged sleeve 28 from the first element 22*a* of the second articulated coupling 22 so that it can slide in the seat 29, leaving the lower frontal toothing 24 disengaged from the frontal toothing 26. Under these conditions, only the first reduction gear 12 will transmit motion to the shaft 13 through the flanged sleeve 27, which is engaged to the first element 22*a* of the second articulated coupling 22 by means of the frontal toothings 23 and 25 and kept in engagement by the ring of screws 50.

FIG. 3 shows the first element 22*a* of the second articulated coupling 22 unscrewed from the flanged sleeve 27 and screwed to the flanged sleeve 28, which is abutting the seat 29. (Note that the elements 22*a* and 22*b* of the second articulated coupling 22 can slide on the toothing 30 to be connected to the flanged sleeve 28.) This constitutes the first step to disconnection of the first reduction gear 12. In order to complete disconnection of the first reduction gear 12, it is further necessary to partly withdraw the shaft 13. Additionally, it is very important to note that the motion (or torque) is transmitted to the shaft 13 always through the first and second elements 22*a* and 22*b* and the toothing 30.

The present invention has been described by way of non-limiting example, but modifications and changes can be made thereto by experts of the art without leaving the scope of protection of the present patent.

I claim:

1. A mechanical transmission comprising:

(a) a shaft having a first end and a second end;

(b) a first flange mounted on the first end of said shaft;

(c) a first articulated coupling mounted on said shaft adjacent to said first flange, said first coupling having frontal teeth facing away from said first flange;

(d) first means for releasably coupling said first articulated coupling to said first flange;

(e) a pulley mounted on said shaft adjacent to said first articulated coupling, said pulley being mounted for free rotation relative to said shaft;

(f) a second flange mounted on said shaft between said pulley and said first articulated coupling, said second flange having frontal teeth facing said first articulated coupling and sized, shaped, and positioned to engage said teeth on said first articulated coupling;

(g) second means for releasably coupling said second flange to said pulley;

(h) a first speed reduction gear assembly mounted on said shaft adjacent said pulley;

(i) a second speed reduction gear assembly mounted on the second end of said shaft, said second speed reduction gear assembly having a longitudinal seat facing said first speed reduction gear assembly, said longitudinal seat having internal longitudinal splines;

(j) a first sleeve mounted on said shaft and connected to said first speed reduction gear assembly on the side facing said second speed reduction gear assembly, said first sleeve having frontal teeth facing away from said first speed reduction gear assembly;

(k) a second sleeve slidably mounted on said shaft and releasably connected to said second speed reduction gear assembly on the side facing said first speed reduction gear assembly, said second sleeve having frontal teeth facing away from said second speed reduction gear assembly and having external longitudinal splines sized, shaped, and positioned to engage said internal longitudinal splines in said seat;

(l) a second articulated coupling mounted on said shaft between said first and second sleeves, said second articulated coupling having frontal teeth facing said first sleeve and sized, shaped, and positioned to engage said teeth on said first sleeve and frontal teeth facing said second sleeve and sized, shaped, and positioned to engage said teeth on said second sleeve;

(m) third means for releasably connecting said first sleeve to said second articulated coupling;

(n) fourth means for releasably connecting said second sleeve to said second articulated coupling; and (o) said second sleeve being sized and shaped so that, when it is released from said second articulated coupling, it can slide into said longitudinal seat and out of engagement with said second articulated coupling.

* * * * *

MECHANICAL TRANSMISSION, PARTICULARLY FOR CABLEWAY WINCHES

This application is a continuation-in-part of application Ser. No. 024,008, filed on Mar. 10, 1987, now abandoned.

FIELD OF THE INVENTION

This invention relates to a mechanical transmission, particularly for cableway winches.

BACKGROUND OF THE INVENTION

Cableways with winches comprising two reduction gears simultaneously operating the same shaft are known. If faults occur or if maintenance is required, one of the reduction gears has to be quickly removed in order to enable the cableway to resume service in the shortest possible time, even though with a single reduction gear.

Such considerations also apply when refitting one of the reduction gears.

The mechanical transmissions of cableway winches do not at present allow rapid replacement or maintenance of their reduction gears, the responsible personnel being required to carry out lengthy and complicated procedures which sometimes also involve the complete dismantling of the transmission.

OBJECT OF THE INVENTION

An object of the present invention is to obviate the aforesaid drawbacks.

A further object of the present invention is to allow one or the other of the two reduction gears to be used at choice, even during normal operation.

SUMMARY OF THE INVENTION

These objects are attained by a mechanical transmission comprising essentially a first and a second speed reduction gear. The first reduction gear is disposed above the second, and a shaft is operated by the first and the second reduction gears. The shaft is provided at its free end with means for its engagement with a pulley coaxially rotatable about the shaft. Between the first and second reduction gears, a first articulated coupling is axially slidable on the shaft and connected thereto, the first articulated coupling is provided with lower toothing and upper toothing. The upper toothing is engageable with a first flanged sleeve rotatably connected to the first reduction gear, and the lower toothing is connected to a second flanged sleeve rotatably connected to the second reduction gear and axially slidable within a seat of the second reduction gear.

BRIEF DESCRIPTION OF THE DRAWINGS

The present invention is described hereinafter with reference to the accompanying drawings in which.

DETAILED DESCRIPTION OF THE PRESENTLY PREFERRED EMBODIMENT

Figure 1:
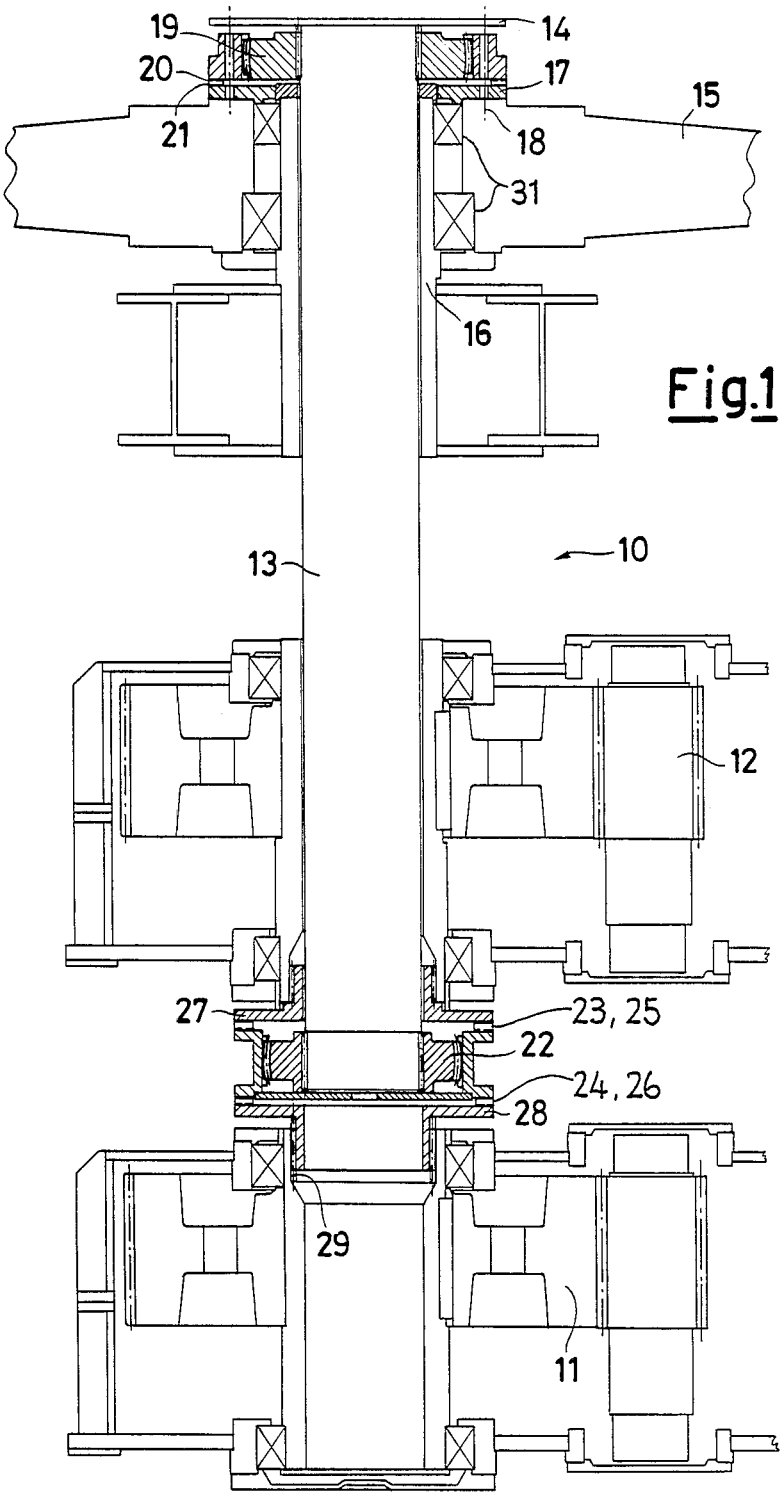
FIG. 1 is a section through a transmission according to the invention, showing the drivetrain in an operative arrangement in which both reduction gears are engaged to transmit torque to the shaft.

In the figures, a reference numeral 10 indicates overall the transmission according to the present invention, and reference numerals 11 and 12 indicate two reduction gears.

The first reduction gear 12, disposed above the second reduction gear 11, operates together with the second reduction gear 11 a shaft 13 provided at its free end with a first flange 14. A pulley 15 is free to rotate about the shaft 13 on bearings 31. The pulley 15 is supported by a support 16, and it is provided with a second flange 17 on the side facing the first flange 14. The first flange 14 is connected by a ring of screws, to a first convex-toothed articulated coupling 19 provided with frontal toothing 20 on the side facing the second flange 17. The first articulated coupling 19 is connected to the shaft 13. The first articulated coupling 19 comprises a first element **19*a* and a second element 19*b***.

The frontal toothing 20 of the first articulated coupling 19 engages with corresponding frontal toothing 21 provided on the second flange 17, to thus implement motion transmission from the shaft 13 to the pulley 15. On the shaft 13 between the two reduction gears 11 and 12 there is provided a second convex-toothed articulated coupling 22 provided with upper frontal toothing 23 on the side facing the first reduction gear 12 and lower frontal toothing 24. The second articulated coupling 22 comprises a first element **22*a* and a second element 22*b***.

The toothings 23 and 24 are engageable, according to their operating position, with analogous frontal toothing 25 and 26 provided on a flanged sleeve 27 and on a flanged sleeve 28, respectively. Additionally, the first element **22*a* of the second articulated coupling 22 is connected by a ring of screws 50 to the flanged sleeve 27 when the toothings 23, 25 are engaged. (See FIG. 2**.)

The flanged sleeve 27 is connected to the first reduction gear 12 by means of a toothing 51, of which only the axes are shown. In the same way, the flanged gear 28 is connected to the second reduction gear 11 by means of a toothing 61.

Figure 3:
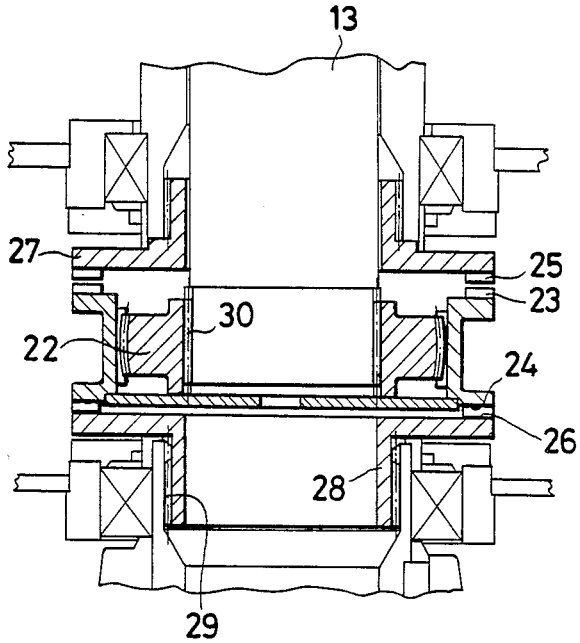
FIG. 3 shows the elements of FIG. 2 in an operating position which is the first step in disengaging the upper reduction gear for maintenance.

The flanged sleeves 27 and 28 are connected respectively to the reduction gears 12 and 11, to enable one or the other or both of them to transmit motion from the reduction gears 12, 11 to the shaft 13. The sleeve 28 can also slide in a seat 29, in such a manner that, depending on its position, it enables one of the two reduction gears 12, 11 to be connected or disconnected. The first element **22*a* of the second articulated coupling 22 is connected by a ring of screws 60 to the flanged sleeve 28 when the toothings 24, 26 are engaged. (See FIG. 3**.)

It will be appreciated that, as is standard in this kind of drivetrain, the torque is transmitted through the frontal toothing parts and not through the screws.

Figure 2:
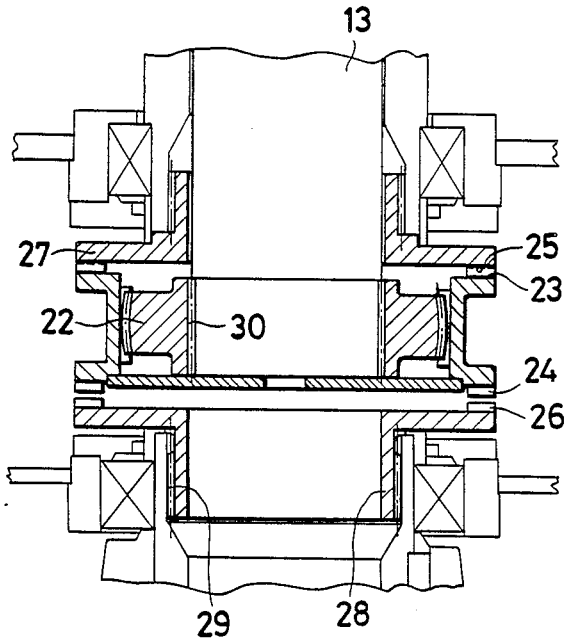
FIG. 2 is a detail of FIG. 1 in an operating position in which the lower reduction gear has been disengaged for maintenance.

In order to disconnect the second reduction gear 11, and thus be able to withdraw it without having to carry out any operation on the first reduction gear 12 and the shaft 13, it is necessary only to release the sleeve 28 from the second reduction gear 11, allowing it to fall under its own weight into the seat 29 until it abuts, as shown in the detailed view of FIG. 2.

In order to disconnect the first reduction gear 12, the sleeve 27 has to be released from the second articulated coupling 22, so that as the sleeve 28 again slides into the seat 29 until it abuts, it also drags with it the second articulated coupling 22, which is free to slide on the